US012571265B2

(12) United States Patent
Peters et al.

(10) Patent No.: US 12,571,265 B2
(45) Date of Patent: Mar. 10, 2026

(54) METHOD FOR PACKAGING COMPONENTS, ASSEMBLIES AND MODULES IN DOWNHOLE TOOLS

(71) Applicant: BAKER HUGHES HOLDINGS LLC, Houston, TX (US)

(72) Inventors: Volker Peters, Wienhausen (DE); Gunnar Bothmann, Celle (DE); Dominik Steinhoff, Grunenplan (DE)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

(21) Appl. No.: 17/095,574

(22) Filed: Nov. 11, 2020

(65) Prior Publication Data

US 2021/0207475 A1 Jul. 8, 2021

Related U.S. Application Data

(63) Continuation of application No. 15/142,917, filed on Apr. 29, 2016, now abandoned.

(51) Int. Cl.

| | |
|---|---|
| ***E21B 47/017*** | (2012.01) |
| ***E21B 17/00*** | (2006.01) |
| ***E21B 17/02*** | (2006.01) |
| ***E21B 23/00*** | (2006.01) |
| ***E21B 23/14*** | (2006.01) |
| ***E21B 49/08*** | (2006.01) |

(52) U.S. Cl.

CPC ..... *E21B 17/025* (2013.01); *E21B 17/00* (2013.01); *E21B 23/00* (2013.01); *E21B 23/14* (2013.01); *E21B 47/017* (2020.05); *E21B 49/084* (2013.01)

(58) Field of Classification Search

CPC ..... E21B 41/00; E21B 47/01; E21B 47/017

See application file for complete search history.

(56) References Cited

U.S. PATENT DOCUMENTS

| | | | |
|---|---|---|---|
| 2,500,252 | A | 3/1950 | Lester |
| 3,518,608 | A | 6/1970 | Michael |
| 3,829,816 | A | 8/1974 | Barry et al. |
| 4,095,865 | A | 6/1978 | Denison et al. |

(Continued)

OTHER PUBLICATIONS

Dictionary definition of "diameter", accessed Jul. 18, 2022 via thefreedictionary.com.*

(Continued)

*Primary Examiner* — Blake Michener

(74) *Attorney, Agent, or Firm* — CANTOR COLBURN LLP

(57) ABSTRACT

The apparatus may include a tool conveyed by a conveyance device. The tool has a body with a load bearing section, an outer surface defined by a diameter, a rotational axis, and a channel in the body extending from an opening at the outer surface. At least a part of the channel is inclined relative to the rotational axis of the body at the axial location of the opening in the body. The apparatus also includes at least one functional element disposed in the channel; and a conduit operatively connected to the at least one functional element transferring at least one of: (i) energy, (ii) a signal, (iii) a fluid, (iv) and formation material. Alternatively, the apparatus includes at least one self-contained functional element disposed in the channel.

22 Claims, 3 Drawing Sheets

(56) References Cited

U.S. PATENT DOCUMENTS

| | | | | |
|---|---|---|---|---|
| 4,291,773 | A * | 9/1981 | Evans | E21B 7/06 175/320 |
| 4,492,865 | A | 1/1985 | Murphy et al. | |
| 4,506,729 | A | 3/1985 | Davis, Jr. et al. | |
| 4,570,481 | A | 2/1986 | Mclaurin | |
| 4,747,304 | A | 5/1988 | King | |
| 4,845,493 | A * | 7/1989 | Howard | E21B 47/13 340/870.31 |
| 5,126,564 | A | 6/1992 | Perry et al. | |
| 5,216,242 | A * | 6/1993 | Perry | G01V 5/107 250/269.1 |
| 5,931,239 | A | 8/1999 | Schuh | |
| 6,195,686 | B1 | 2/2001 | Moon et al. | |
| 6,241,022 | B1 | 6/2001 | Mailand et al. | |
| 6,470,979 | B1 | 10/2002 | Wentworth et al. | |
| 6,523,609 | B1 | 2/2003 | Miszewski | |
| 6,705,406 | B2 * | 3/2004 | Das | E21B 47/01 166/381 |
| 6,915,686 | B2 * | 7/2005 | Baustad | E21B 47/06 73/152.46 |
| 7,364,007 | B2 | 4/2008 | Garcia-Osuna et al. | |
| 8,200,048 | B2 | 6/2012 | Vidal et al. | |
| 8,342,865 | B2 | 1/2013 | Scheibelmasser et al. | |
| 8,376,065 | B2 | 2/2013 | Teodorescu et al. | |
| 8,844,654 | B2 | 9/2014 | Boulet | |
| 8,955,586 | B1 | 2/2015 | Randa et al. | |
| 9,068,405 | B2 | 6/2015 | Sherrill et al. | |
| 9,097,100 | B2 | 8/2015 | Finke et al. | |
| 2003/0079913 | A1 | 5/2003 | Eppink et al. | |
| 2003/0178203 | A1 | 9/2003 | Griffiths | |
| 2004/0065437 | A1 | 4/2004 | Bostick et al. | |
| 2004/0168794 | A1 | 9/2004 | Vold | |
| 2004/0251048 | A1 | 12/2004 | Kurkoski | |
| 2005/0150655 | A1 | 7/2005 | Duong et al. | |
| 2005/0205299 | A1 | 9/2005 | Michael et al. | |
| 2006/0065395 | A1 * | 3/2006 | Snell | E21B 41/0078 175/45 |
| 2007/0199718 | A1 | 8/2007 | Boyd | |
| 2009/0260876 | A1 | 10/2009 | Gleitman | |
| 2010/0111592 | A1 * | 5/2010 | Hassell | E21B 47/12 403/24 |
| 2010/0116550 | A1 | 5/2010 | Hutin et al. | |
| 2010/0132434 | A1 | 6/2010 | Moake | |
| 2011/0054808 | A1 | 3/2011 | Pearce et al. | |
| 2011/0185807 | A1 | 8/2011 | Albrecht et al. | |
| 2012/0096935 | A1 | 4/2012 | Finke et al. | |
| 2013/0061668 | A1 | 3/2013 | Moake | |
| 2013/0213711 | A1 | 8/2013 | Cartellieri et al. | |
| 2014/0260591 | A1 | 9/2014 | Rodgers et al. | |
| 2015/0167393 | A1 | 6/2015 | Rasheed | |
| 2016/0024854 | A1 | 1/2016 | Clingman et al. | |
| 2016/0161042 | A1 | 6/2016 | Green et al. | |
| 2016/0168923 | A1 | 6/2016 | Richards et al. | |

OTHER PUBLICATIONS

Dictionary definition of "diameter" accessed Sep. 8, 2022 via www.thefreedictionary.com.*

Dictionary definition of "actuate" accessed Jan. 10, 2024 via thefreedictionary.com.*

PCT/US2017/029647—International Search Report dated Jul. 25, 2017.

European Search Report for European Application No. 17790348.1; Report Mail Date Nov. 25, 2019 (pp. 1-7).

* cited by examiner

METHOD FOR PACKAGING COMPONENTS, ASSEMBLIES AND MODULES IN DOWNHOLE TOOLS

CROSS REFERENCE TO RELATED APPLICATIONS

This application is a continuation of U.S. patent application Ser. No. 15/142,917, filed Apr. 29, 2016, the disclosure of which is incorporated herein by reference in its entirety.

BACKGROUND OF THE DISCLOSURE

1. Field of the Disclosure

This disclosure relates generally to packaging components and assemblies in a work string used in a borehole.

2. Background of the Art

Oilfield wellbores are drilled by rotating a drill bit conveyed into the wellbore by a drill string. The drill string includes a drill pipe (tubing) that has at its bottom end a drilling assembly (also referred to as the "bottomhole assembly" or "BHA") that carries the drill bit for drilling the wellbore. A suitable drilling fluid (commonly referred to as the "mud") is supplied or pumped under pressure from a source at the surface down the tubing. Conventionally, the drilling fluid flows via a central flow bore along the tubing. Thus, the various components and assemblies that may be conveyed by the drill string are preferably housed in the annular body surrounding one or more flow bores. These flow bores may be centrally located or off-center. Traditional housing arrangements include cover sleeves, hatch covers, probe based, and mega frame packaging. For logging existing wellbores, wireline instruments are lowered into the wellbore by means of a wire. Wireline instruments carry equipment by similar technologies as referred to above.

The present disclosure provides packaging arrangements that do not have the drawbacks of traditional packaging arrangements.

SUMMARY OF THE DISCLOSURE

In aspects, the present disclosure provides an apparatus for use in a borehole. The apparatus may include a tool conveyed by a conveyance device. The tool has a body with a load bearing section, an outer surface defined by a diameter, a rotational axis, and a channel in the body extending from an opening at the outer surface. At least a part of the channel is inclined relative to the rotational axis of the body at the axial location of the opening in the body. The apparatus also includes at least one functional element disposed in the channel; and a conduit operatively connected to the at least one functional element transferring at least one of: (i) energy, (ii) a signal, (iii) a fluid, (iv) and formation material.

In aspects, the present disclosure also provides a method for using a tool adapted for a borehole. The apparatus may include a tool conveyed by a conveyance device. The tool has a body with a load bearing section, an outer surface defined by a diameter, a rotational axis, and a channel in the body extending from an opening at the outer surface. At least a part of the channel is inclined relative to the rotational axis of the body at the axial location of the opening in the body. The apparatus also includes at least one self-contained functional element disposed in the channel.

Examples of certain features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, reference should be made to the following detailed description of the preferred embodiment, taken in conjunction with the accompanying drawing.

DETAILED DESCRIPTION OF THE DISCLOSURE

The present disclosure provides arrangements and related methods for packaging "functional elements." As used herein, a "functional element" is a physical body or assembly that is designed to execute one or more pre-determined functions either at the surface or downhole. The executed function may be done autonomously or in response to a command signal. Also, the functional device may be dynamic and move between a non-activated state and an activated state, or vice versa. This is contrasted with static devices such as bolts, hatches, and other inert structures. The teachings of the present disclosure may be used with any tool or section of a tool conveyed by a conveyance device into a wellbore/borehole. The conveyance device may be a rigid carrier such as jointed pipe including wired pipe, or a non-rigid carrier such as coiled tubing, wireline, slick-line, e-line, etc. Merely for convenience, a drill string will be used as an exemplary conveyance device in the discussion below.

Figure 1:
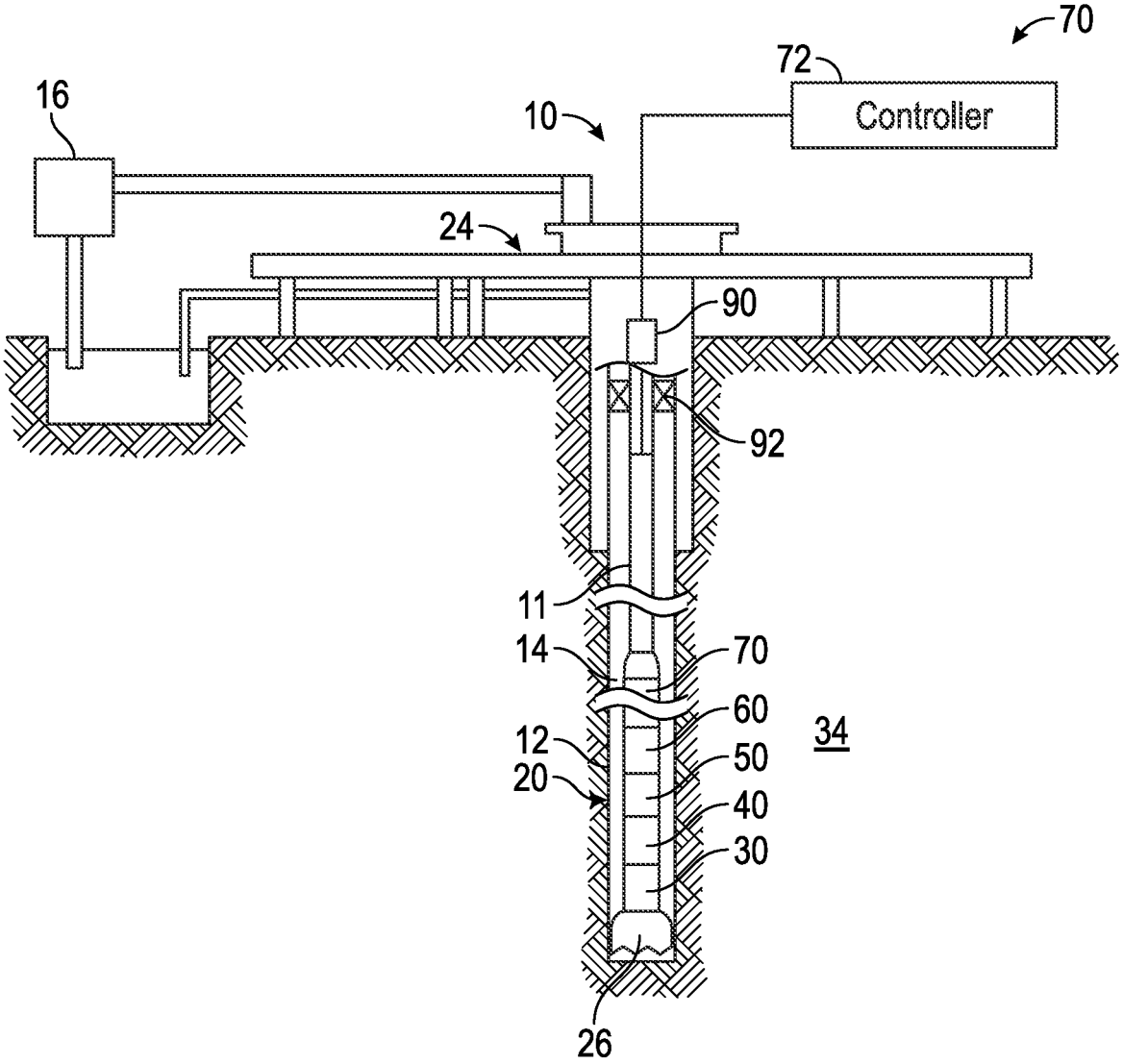
FIG. 1 is a schematic illustration of one embodiment of a drilling system that may incorporate a communication system according to embodiments of the present disclosure.

Referring initially to FIG. 1, there is schematically illustrated an elevation view of a system 10 for the construction, logging, completion or work-over of a wellbore 12. The system 10 includes a drill string 11 and a bottomhole assembly (BHA) 20. In one embodiment, the drill string 11 may be made up of a section of rigid tubulars (e.g., jointed tubular). The drill string 11 may be rotated by a top drive 24 or other suitable rotary power device. In one non-limiting embodiment, the BHA 20 includes a drill bit 26, a steering unit 30, a drilling motor 40, a sensor sub 50, a bidirectional communication and power module (BCPM) 60, and a formation evaluation (FE) sub 70. In other configurations, the BHA 20 may include active stabilizers, under-reamers, tractors, thrusters, downhole blow-out preventers, etc. During drilling, a drilling fluid flows down a flow bore of the drill string 11 and flows up an annulus formed between the drill string 11 and a wall defining the wellbore 12.

Figure 2A:
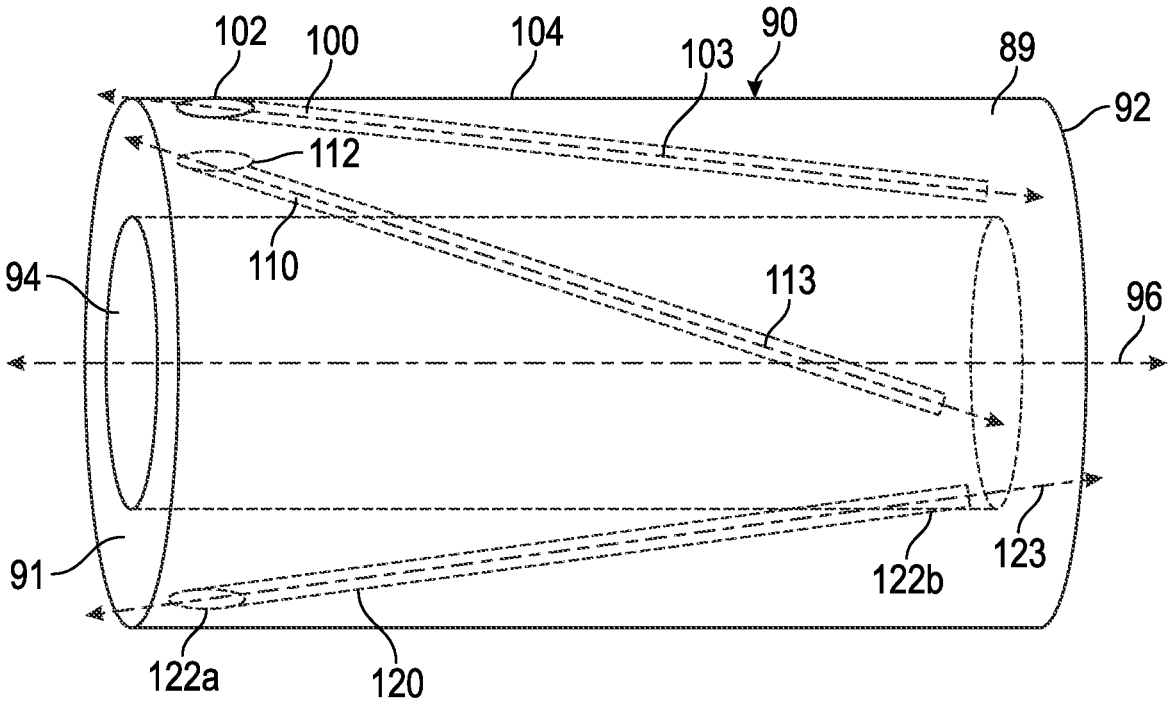
FIGS. 2A and B schematically illustrate channels formed in a body with a load bearing section of a drill string according to embodiments of the present disclosure.

Referring to FIG. 2A, there is shown a section 90 of the drill string 11 (FIG. 1), which may be a drill pipe or any of the components making up the BHA 20 (FIG. 1) or any other section of the drill string 11. The section 90 has a body 89 with a load bearing section 92 and a flow bore 94, which may be centrally positioned or off-center. The section 90 has a rotational axis 96, which is one of the three major axes or principal axes of the tool. The rotational axis 96 may be the axis about which the section 90 rotates. If the section 90 does not rotate, then the rotational axis 96 may be an axis that bisects the section 90. In some embodiments, the rotational axis 96 may be aligned with the flow of fluid along the flow bore 94. The tool section 90 has an outer surface 104 that is defined by a diameter. That is, the outer surface 104 extends axially a specified distance along a non-varying diameter. In some embodiments, the outer surface 104 may be considered a circumferential surface. As shown, the rotational axis 96 is parallel with the outer surface 104.

The teachings of the present disclosure provide enable the packaging of a functional element directly to the load bearing section 92 of a bottomhole assembly or other well tool. These packaging methods can provide greater flexibility in size, accessibility, and maintainability while keeping internal flow bore(s) 94 free. For example, the cross-sectional flow area of the flow bore 94 does not have to be reduced and flow does not have to be diverted from the central axis of the section 90.

Referring to FIGS. 2A and B, a channel 100 may be formed in the load bearing section 92 for receiving one or more objects. By load carrying region 92, it is meant the physical mass that bears and transfers compression, tension, bending and/or torsional loadings across the section 90. The channel 100 may have an opening 102 that is accessible from outside of the section 90. That is, the opening 102 is at least partially formed to penetrate the outer surface 104 of the section 90. It should be noted that the end faces of the section 90 are not accessible as they connect to adjacent tools and are effectively inside the tool string or bottomhole assembly. In one non-limiting embodiment, the channel 100 may have circular cross-sectional profile. In one non-limiting embodiment, at least a portion of the length of the channel 100 is enclosed or covered by the outer surface 104. In still other embodiments, a majority of the length of the channel 100 is enclosed or covered by the outer surface 104.

Figure 2B:
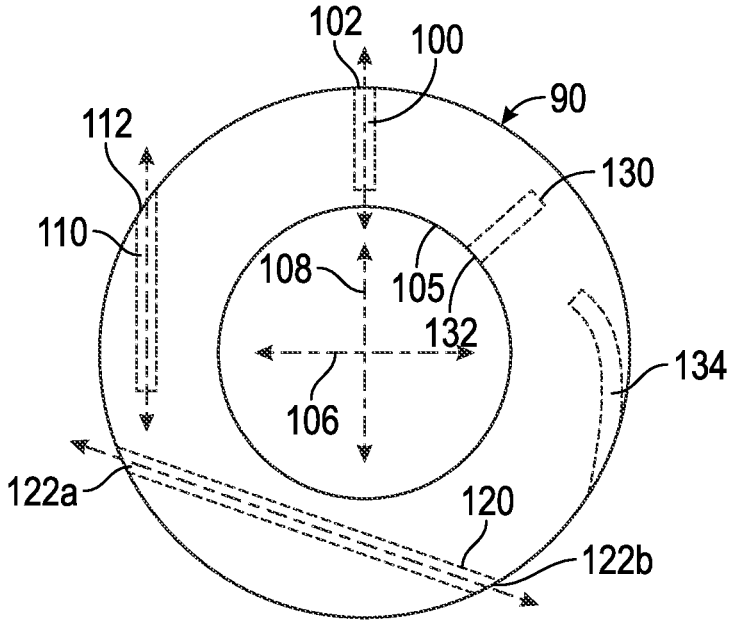

The channels according to the present disclosure may have various orientations, which are illustrated in FIGS. 2A-B using channels 100, 110, and 120. For ease of explanation, the section 90 may be considered as having two non-parallel planes, such as a horizontal plane 106 and a vertical plane 108, both of which are parallel with the rotational axis 96.

The channel 100 is inclined and is directed to the center of the section 90. As used herein, "inclined" means that the channel 100 has a longitudinal axis 103 that has a non-zero slope relative to the horizontal plane 106 but not orthogonal to the rotational axis 96. That is, the incline is greater than zero and less than ninety degrees. The channel 100 may also be described as inclined and extending radially inward from the outer surface 104; i.e., that is the channel 100 extends at an angle greater than zero and less than ninety degrees from the outer surface 104. In embodiments, at least a part of the channel 100 that is inclined is at the axial location of the opening 102 in the body 89. That is, the inclination begins or terminates at the opening 102.

The channel 110 may be offset from the vertical plane 108 and extend radially downward in a straight line from the opening 112. Like the channel 100, the longitudinal axis 113 (FIG. 2A) of the channel 110 has a component that is non-parallel with the horizontal plane 106 (FIG. 2B). This component is parallel with the vertical plane 108.

The channel 120 may be offset from the vertical plane 108 and extend radially downward in a straight line from the opening 122*a*. Different from the channels 100, 110, the longitudinal axis 123 of the channel 120 has a component non-parallel with the horizontal plane 106 and a component non-parallel with the vertical plane 108. Another difference is that channel 100, 110 are "blind" holes. The channel 120 is different in that it extends all the way through the section 90 and can have a second opening 122*b* on the outer surface 104 as shown in FIG. 2B. Also, one or more passages (not shown) may communicate with the channels 100, 110, 120. These passages (not shown) may be used to convey wiring, hardware, fluid lines, etc. to the equipment in the channels 100, 110, 120.

It should be appreciated that the channels according to the present disclosure are susceptible to numerous variations. The channels can have non-circular cross sectional profile (not shown). A channel 130 may extend from an opening 132 formed at an inner surface 105. An opening may also be formed at an end face 91 of a section 90. Further, the channels according to the present disclosure can be non-linear. For example, a channel 134 may be curved to increase the available length for packaging a functional element. Still other channel geometries may use a slight deviation from a straight line to bring a functional element into intimate contact with the tool body to generate a pre-stress on the functional element. For instance, the channel and the functional element may have longitudinal axes that are not parallel along the whole length of the functional element when the functional element is in the channel. Thus, the functional element is in contact with the body, and the contact generates a pre-stress on the functional element. Also, the channel may include composite geometries such as one or more linear segments and one or more non-linear segments (e.g., curved segments). These segments themselves may have different geometries (e.g., different slopes or curvatures). In still other embodiments, the channels according to the present disclosure may be contoured. For instances, the channels according to the present disclosure may have different channel diameters in different sections, which form a stepped diameter channel or may have other contours such as grooves, recesses, cavities or the like.

Figure 4:
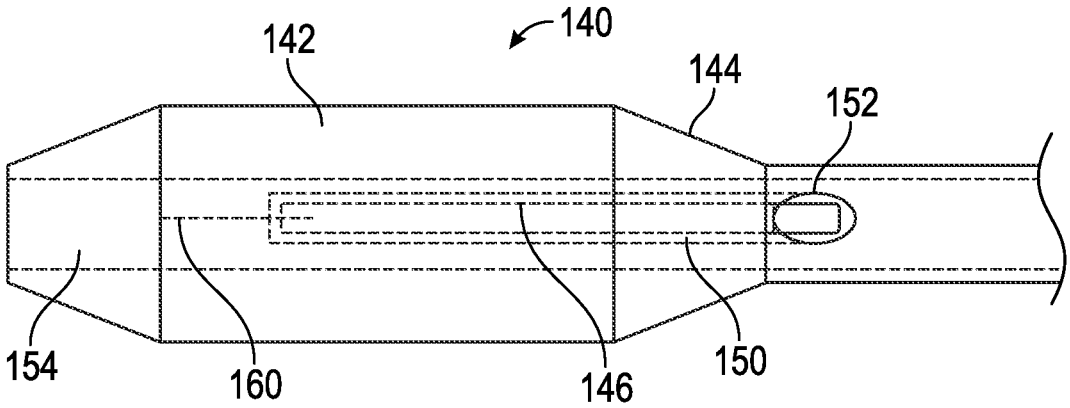
FIG. 4 schematically illustrates a functional element packaged in a channel according to one embodiment of the present disclosure and used in conjunction with a valve actuation assembly.

In some embodiments, a functional element may be operatively connected to a conduit 160 as shown in FIG. 4. The conduit 160 can transfer to the functional element at least one of: (i) energy, (ii) a signal, (iii) a fluid, (iv) and formation material. The conduit 160 may include a media that transmits signals between the functional element 146 and a separate component (not shown). The signal may be data signals or energy. For instance, the signal carrier may be a cable, wire, fiber, or other solid media that conveys electromagnetic signals, optical signals, or acoustic signals. The signal carrier may also be a conduit such as tubing or a channel that conveys fluid based pressure signals. These signals may be used to convey data. Also, the signal carrier may transmit energy in the form of electrical energy or pressurized fluid. The term "operatively connected" means that the functional element is energized via the connection and/or the functional element receives/transmits signals encoded with data via the connection.

In other embodiments, the functional element can be self-contained. By self-contained, it is meant that the functional element can perform one or more functions without an operative connection, as described above, that supplies power and/or data. That is, the functional element autonomously performs one or more functions downhole by using an on-board power supply and controls.

Without being bound to any particular manufacturing method, non-linear or curved channels can be manufactured using drilling (standard), EDM (standard), ECM, metal forming, casting or additive manufacturing technologies. Channels (cavities) can also be created using more than one component; e.g., mandrel and sleeve having both ½ of the channel, split longitudinally, can form a channel when both pieces are assembled.

Figure 3:
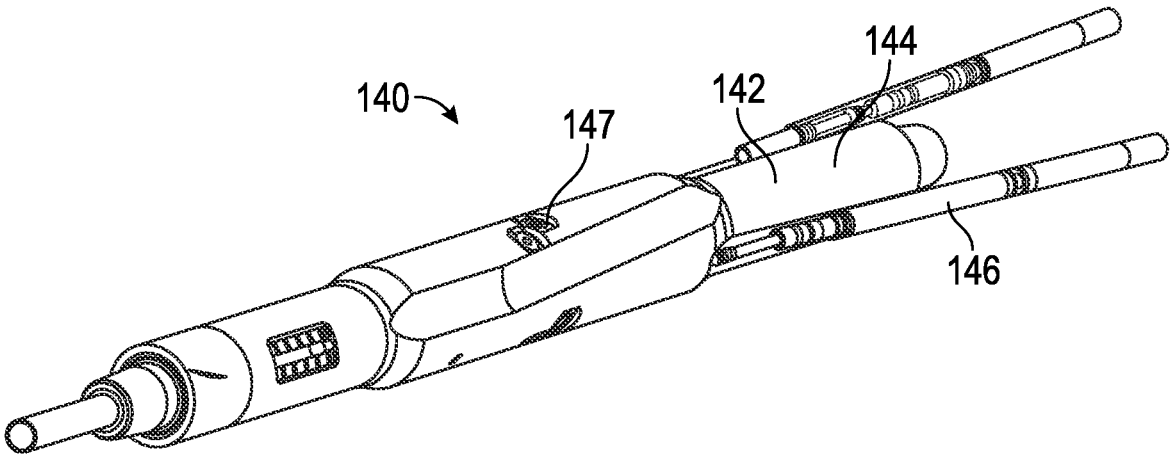
FIG. 3 schematically illustrates a functional element packaged in a channel according to one embodiment of the present disclosure used in conjunction with a valve actuation assembly.

Referring now to FIG. 3, there is shown an valve actuation assembly 140 that may be used to control the flow of a borehole. The valve actuation assembly 140 has a body with a load bearing section 142 defined by an outer surface 144. Channels, as discussed above, may be formed in the body 142 to house a functional element which by way of non-limiting example may be an electro-hydraulic actuator 146. For visualization purposes the electro-hydraulic actuator is shown before installation into the receiving channel. By non limiting example, the electro-hydraulic actuator can be configured to make electrical connection (for power and communication) while being slid into the receiving channel. In other embodiments the electrical connection is made from hatch ports 147 after assembly of the electro-hydraulic actuator.

Referring to FIG. 4, there is shown a section of any downhole tool, but for simplicity will be referred to the valve actuation assembly 140 shown in FIG. 3. A channel 150 is formed in the body 142 to house a functional element, such as the electro-hydraulic actuator 146. The channel 150 has an opening 152 formed at the outer surface 144 and extends into the body 142. As described previously, the channel 150 has an orientation that causes it to be non-parallel with the rotational axis of the valve actuation assembly 140. It should be noted that the actuator 146 is fixed in the body 142 in such a manner that fluid may flow across the body 142 via a centrally positioned flow bore 154.

It should be appreciated that channels according to the present disclosure may be used to package various types of functional elements. Functional elements can include tooling, instruments, and other kinds of mechanical, electro-mechanical, electric, electronic, hydraulic, or pneumatic equipment. Merely by way of example, such equipment may include signal-responsive actuators, electronics, sensors, batteries, energy emitting source (e.g., acoustic sources and radiation sources), hydraulic pumps, hydraulic actuators, electro-mechanical actuators, valves, vessels such as sample tanks to store formation material, including core barrels, or fluid reservoirs, antennas, fluid sampling tools, communication devices, steering ribs, active stabilizers, etc. A functional element may be powered electrically, hydraulically, or mechanically (e.g., using electricity, pressurized fluid, compressed springs, etc.) and controllable (e.g., responsive to control signals, and/or programmed).

Moreover, while a valve actuation assembly has been shown, it should be appreciated that a functional element may be used with any type of downhole tool, including, but not limited to, all types of reamers, anchoring tools, open-hole packers, casing packers, bridge plugs, string valves, bypass valves, (rotary) steering tools, tank carriers, pressure testing tools, sampling tools, coring tools, MWD sensor (seismic, resistivity, acoustic, gamma, NMR, etc.), pressure measurement devices, etc.

It should be appreciated that the packaging arrangements using channels according to the present disclosure provide numerous advantages over the conventional packaging arrangements. First, a functional element packaged in an above-described channel is accessible without disassembling a downhole tool. Thus, for instance, a functional element may be inserted into the downhole tool after the downhole tool is assembled via the opening of the channel on the outer surface of the downhole tool. Also, when the downhole tool is retrieved from the borehole, personnel can easily access the functional element without disturbing the joints, connections, or other portions of the downhole tool. That is, the downhole tool may be retrieved via the channel open and/or tools or instruments may be inserted through the channel opening to work on the functional element. Therefore, service activities such as maintenance, repair, refurbishment, and change-outs can be accomplished relatively quickly because no time-consuming disassembly of the downhole tool is required. Also, as noted previously, the functional elements are packaged in a manner that does not obstruct the flow of drilling fluid through the central flow bore (e.g., flow bore 94 of FIG. 2A) of the drill string 11 (FIG. 1).

While the foregoing disclosure is directed to certain embodiments of the disclosure, various modifications will be apparent to those skilled in the art. It is intended that all variations within the scope of the appended claims be embraced by the foregoing disclosure.

What is claimed is:

1. An apparatus for use in a borehole, comprising:

a conveyance device;

a tool conveyed by the conveyance device, the tool having a body with a load bearing section, an outer surface defined by a diameter, a rotational axis, and a channel in the body, wherein the channel is a blind hole extending from an opening in the outer surface along a longitudinal axis, wherein the opening is accessible from outside the tool, wherein a portion of the longitudinal axis is non-parallel with a plane that contains the rotational axis and the opening;

at least one actuator disposed in the channel, the at least one actuator being actuated by at least one of (i) energy, (ii) a signal, and (iii) a fluid; and a conduit having a signal carrier operatively connected to the at least one actuator, the conduit transporting, through the signal carrier, the at least one of: (i) the energy, (ii) the signal, and (iii) the fluid to or from the at least one actuator while the tool is in the borehole.

2. The apparatus of claim 1, wherein the channel has at least one of: (i) a linear segment, (ii) a curved segment, (iii) two segments having different geometries, (iv) and a contoured segment.

3. The apparatus of claim 1, wherein the body includes a flow bore and the conveyance device is a drill string.

4. The apparatus of claim 1, wherein the at least one actuator comprises at least one of: an electronic device, an optic device, a sensor, a hydraulic device, and a valve.

5. The apparatus of claim 4, wherein the at least one actuator is sized to be insertable and retrievable via the opening.

6. The apparatus of claim 1, wherein the channel extends from the opening at the outer surface of the body through the body to a second opening at the outer surface of the body.

7. The apparatus of claim 1, wherein the at least one actuator includes an actuator axis, the actuator axis and the longitudinal axis of the channel are not parallel along a portion of the length of the at least one actuator when the at least one actuator is in the channel, the at least one actuator is in contact with the body, the contact generates a pre-stress on the at least one actuator.

8. The apparatus according to claim 1, wherein the portion of the longitudinal axis is inclined relative to the rotational axis of the body at the axial location of the opening.

9. An apparatus for use in a borehole, comprising:

a conveyance device;

a tool conveyed by the conveyance device, the tool having a body with a load bearing section, an outer surface defined by a diameter, a rotational axis, and a channel formed in the body, wherein the channel is a blind hole extending from an opening at the outer surface along a longitudinal axis, wherein the opening is accessible from outside the tool, wherein at least a portion of the longitudinal axis is non-parallel with a plane that contains the rotational axis and the opening;

at least one actuator disposed in the channel; and a conduit having a signal carrier extending through the apparatus, the conduit transporting, through the signal carrier, the at least one of: (i) an energy, (ii) a signal, and (iii) a fluid to or from the at least one actuator while the tool is in the borehole.

10. A method for using a tool adapted for a borehole, comprising:

positioning the tool on a conveyance device, the tool having a body with a load bearing section and an outer surface, wherein the body has a rotational axis and a channel formed in the body, wherein the channel is a blind hole extending from an opening at the outer surface along a plane defined by the rotational axis and the opening, wherein the opening is accessible from outside the tool, wherein at least a part of the channel has a component that is non-parallel with the plane;

disposing at least one actuator in the channel; and operatively connecting a conduit having a signal carrier to the at least one actuator; and transporting through the signal carrier at least one of: (i) the energy, (ii) a signal, and (iii) a fluid to or from the at least one actuator while the tool is in the borehole.

11. The method of claim 10, wherein the channel has at least one of: (i) a linear segment, (ii) a curved segment, (iii) two different geometries, (iv) and a contoured segment.

12. The method of claim 10, wherein the body includes a central flow bore and the conveyance device is a drill string, and further comprising flowing a drilling fluid through the drill string.

13. The method of claim 10, further comprising manipulating the at least one actuator by one of: (i) inserting the at least one actuator via the opening, and (ii) retrieving the at least one actuator via the opening.

14. The method of claim 10, further comprising servicing the at least one actuator via the opening.

15. The method of claim 14, wherein servicing comprises one of: (i) calibrating the at least one actuator; and (ii) testing the at least one actuator.

16. The method of claim 10, further comprising replacing the at least one actuator with a second actuator via the opening.

17. The method of claim 10, further comprising activating the at least one actuator by the at least one of (i) the energy, (ii) the signal, and (iii) the fluid.

18. An apparatus for use in a borehole, comprising:

a conveyance device;

a tool conveyed by the conveyance device, the tool having a body including a load bearing section, an outer surface defined by a diameter, a rotational axis, and a channel, wherein the channel is a blind hole extending at an angle from an opening at the outer surface into the body, the channel having a longitudinal axis, wherein the opening is accessible from outside the tool, wherein at least a portion of the longitudinal axis is non-parallel with a plane that contains the rotational axis and the opening;

at least one actuator assembled in the channel;

at least one hatch port disposed at the opening in the outer surface and configured to make an electrical connection to the at least one actuator after assembly of the at least one actuator in the channel; and a conduit having a signal carrier operatively connected to the at least one actuator, the conduit transporting, through the signal carrier, at least one of: (i) energy, (ii) a signal, and (iii) a fluid to or from the at least one actuator.

19. An apparatus for use in a borehole, comprising:

a conveyance device;

a tool conveyed by the conveyance device, the tool having a body including a load bearing section, an outer surface defined by a diameter, a rotational axis, and a channel, wherein the channel is a blind hole extending from an opening at the outer surface along a plane defined by the rotational axis and the opening, wherein the opening is accessible from outside the tool, wherein at least a part of the channel has a component that is non-parallel with the plane;

at least one actuator disposed in the channel; and a conduit having a signal carrier extending through the apparatus operatively connected to the at least one actuator, the conduit transporting, through the signal carrier, the at least one of: (i) an energy, (ii) a signal, and (iii) a fluid, to or from the at least one actuator while the tool is in the borehole.

20. The apparatus of claim 19, wherein the at least one actuator is energized by the at least one of (i) the energy, (ii) the signal, and (iii) the fluid passing through the signal carrier interior path of the conduit into the channel.

21. An apparatus for use in a borehole, comprising:

a conveyance device;

a tool conveyed by the conveyance device, the tool having a body including a load bearing section, an outer surface defined by a diameter, a rotational axis, a channel formed in the body, wherein the channel is a blind hole extending from an opening at the outer surface along a plane defined by the rotational axis and the opening, wherein the opening is accessible from outside the tool, wherein at least a part of the channel has a component that is non-parallel with the plane;

at least one actuator disposed in the channel; and a conduit having a signal carrier extending through the apparatus, the conduit transporting, through the signal carrier interior path, the at least one of: (i) an energy, (ii) a signal, and (iii) a fluid to or from the at least one actuator while the tool is in the borehole.

22. An apparatus for use in a borehole, comprising:

a conveyance device;

a tool conveyed by the conveyance device, the tool having a body with a load bearing section, an outer surface defined by a diameter, a rotational axis, and a channel in the body, wherein the channel is a blind hole extending from an opening at the outer surface along a longitudinal axis, wherein the opening is accessible from outside the tool, a horizontal plane is defined parallel with the rotational axis and through the opening and a vertical plane is defined parallel with the rotational axis, wherein at least a portion of the channel is non-parallel with the horizontal plane and non-parallel with the vertical plane;

at least one actuator disposed in the channel; and a conduit having a signal carrier operatively connected to the at least one actuator, the conduit transporting, through the signal carrier, transferring the at least one of: (i) energy, (ii) a signal, and (iii) a fluid to or from the least one actuator in the borehole.

* * * * *